United States Patent [19]

Trombettas

[11] 4,452,011

[45] Jun. 5, 1984

[54] GRILL-TYPE WINDOW GATE APPARATUS

[76] Inventor: David T. Trombettas, 41-35 45th St., Long Island City, N.Y. 11104

[21] Appl. No.: 375,404

[22] Filed: May 6, 1982

[51] Int. Cl.[3] ..... E06B 3/68

[52] U.S. Cl. ..... 49/56; 49/63; 49/449

[58] Field of Search ..... 49/56, 63, 57, 50, 449, 49/450, 141

[56] References Cited

U.S. PATENT DOCUMENTS 802,983 10/1905 Gilbert ..... 49/449 X 1,633,848 6/1927 Dandridge ..... 49/57

4,249,345 2/1981 Littleton ..... 49/56

*Primary Examiner*—Philip C. Kannan

*Attorney, Agent, or Firm*—Philip D. Amins

[57] ABSTRACT

A grill-type window gate apparatus includes a frame which is mounted in a window opening and a grillwork panel which is movably mounted on the frame. A panel lock assembly is mounted on the grillwork panel and is capable of locking the grillwork panel to the frame when the grillwork panel is in a closed position. A window lock assembly is mounted on the frame and engages the grillwork panel when the same is in the closed position thereby locking a window assembly which is mounted in the window opening.

19 Claims, 13 Drawing Figures

36
38
6
32
4
40
70
68
24
28
14
12
30
20
18
76
80
84
82
78
22
16
10
146
148
144
3
138
7
56
140
34
142
58
86
54
90
88
160
154
152
156
158
150
114
96
104
98
102
106
94
26
100
92

FIG. 11
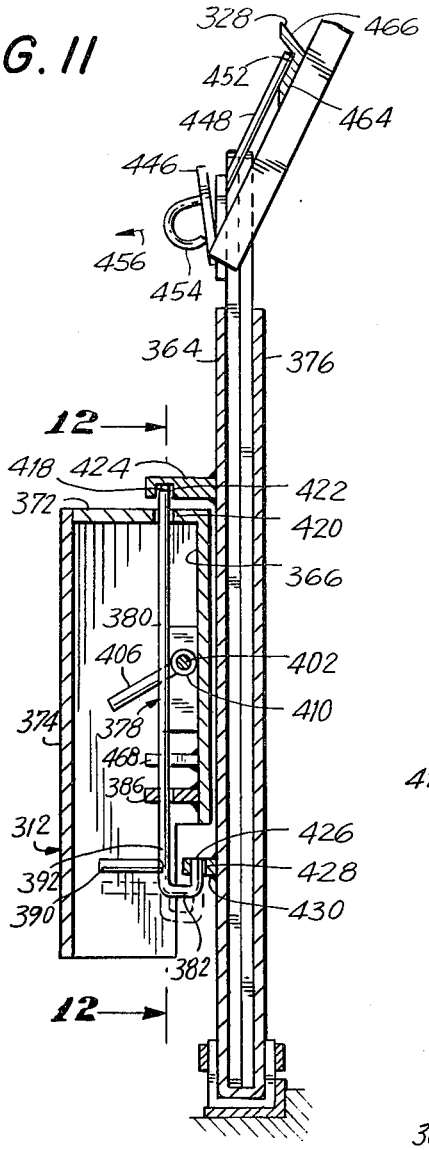
FIG. 12
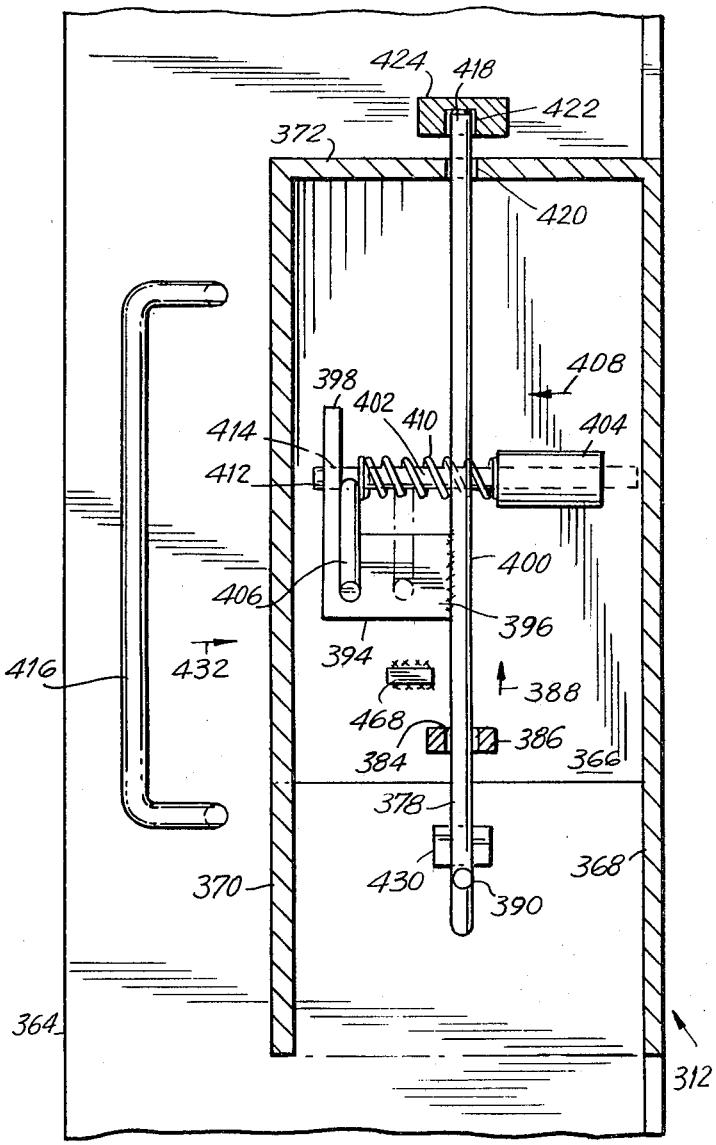
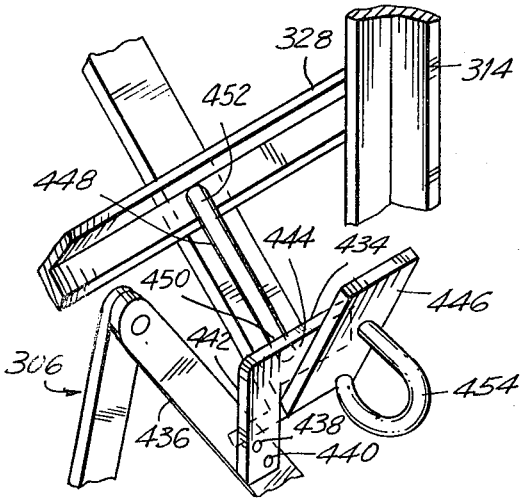
FIG. 13

GRILL-TYPE WINDOW GATE APPARATUS

BACKGROUND OF THE INVENTION

The continuing need for effective, safe and economical protection of commercial and residential buildings against unauthorized entry has led to a need for an improved window gate apparatus.

A window gate apparatus, in order to be acceptable, must provide security against unauthorized entry from the outside and ease of egress from the inside of the building. The operation of locking and unlocking the apparatus must be both simple and foolproof. In addition, it is highly desirable that the window gate apparatus incorporate a window lock which can be used to lock the window on which the apparatus is mounted and thereby prevent an intruder from opening the window and tampering with the apparatus. The operation of locking and unlocking the window must also be simple and foolproof.

The need for a window gate apparatus which effectively combines the functions of locking the gate portion of the apparatus and locking the window, on which the apparatus is mounted, has led to the rejection of the window gates known in the prior art, included among which are devices shown in U.S. Pat. Nos. 980,535; 1,438,202; 1,633,848; 1,855,865; 3,953,939 and 4,070,048.

OBJECTS OF THE INVENTION

It is the primary object of the present invention to provide an improved window gate apparatus.

It is a further object of the present invention to provide a grill-type window gate apparatus which incorporates an operating mechanism which serves to lock the window on which the apparatus is mounted.

It is yet another object of the present invention to provide a grill-type window gate apparatus which incorporates an operating mechanism which serves to lock the window on which the apparatus is mounted.

It is still another object of the present invention to provide a grill-type window gate apparatus which incorporates an operating mechanism having a high degree of reliability.

It is another object of the present invention to provide a grill-type window gate apparatus which provides a high degree of security against unauthorized entry.

It is a further object of the present invention to provide a grill-type window gate which provides an easy means of exit through the window.

It is yet another object of the present invention to provide a grill-type window gate which can be easily mounted on conventional double-hung windows.

A further object of the present invention is to provide a grill-type window gate which comprises a relatively small number of component parts, each of which is simple in construction resulting in a relatively low overall cost.

SUMMARY OF THE INVENTION

In accordance with a first embodiment of the invention, there is provided a grill-type window gate which includes a frame assembly which is mounted on the window jamb of a window opening. A grillwork panel which comprises a rectangular array of bars is slideably mounted on the frame assembly and is capable of vertical movement from a lower position to an upper position. A panel lock assembly which includes a pair of horizontally disposed slideably mounted bolts is located on the lower portion of the grillwork panel. The bolts may be extended to engage the frame assembly and thereby lock the grillwork panel to the frame assembly. A window lock assembly is mounted on the frame assembly and includes a plurality of members one of which engages an upper portion of the grillwork panel and which causes a second member to be positioned between the upper and lower window frames of a double-hung window, which is mounted on the window jamb. The second member prevents an intruder from moving the upper window frame downwardly or moving the lower window frame upwardly.

A second embodiment of the invention includes a scissors-type window grill which moves in a horizontal direction from a closed to an open position. A window lock assembly mounted on the frame engages an upper portion of the grill to lock a double-hung window as in the first embodiment of the invention. A panel lock assembly is mounted on a lower portion of the frame assembly and includes a slideably mounted, vertically oriented bolt which engages a pair of bracket members on the grill to lock the grill to the frame assembly.

BRIEF DESCRIPTION OF THE DRAWINGS

The foregoing and other objects, features and advantages of the present invention will become more readily apparent to those skilled in the art from the detailed description hereinafter, considered in conjunction with the accompanying drawings wherein.

Figures 1, 2:
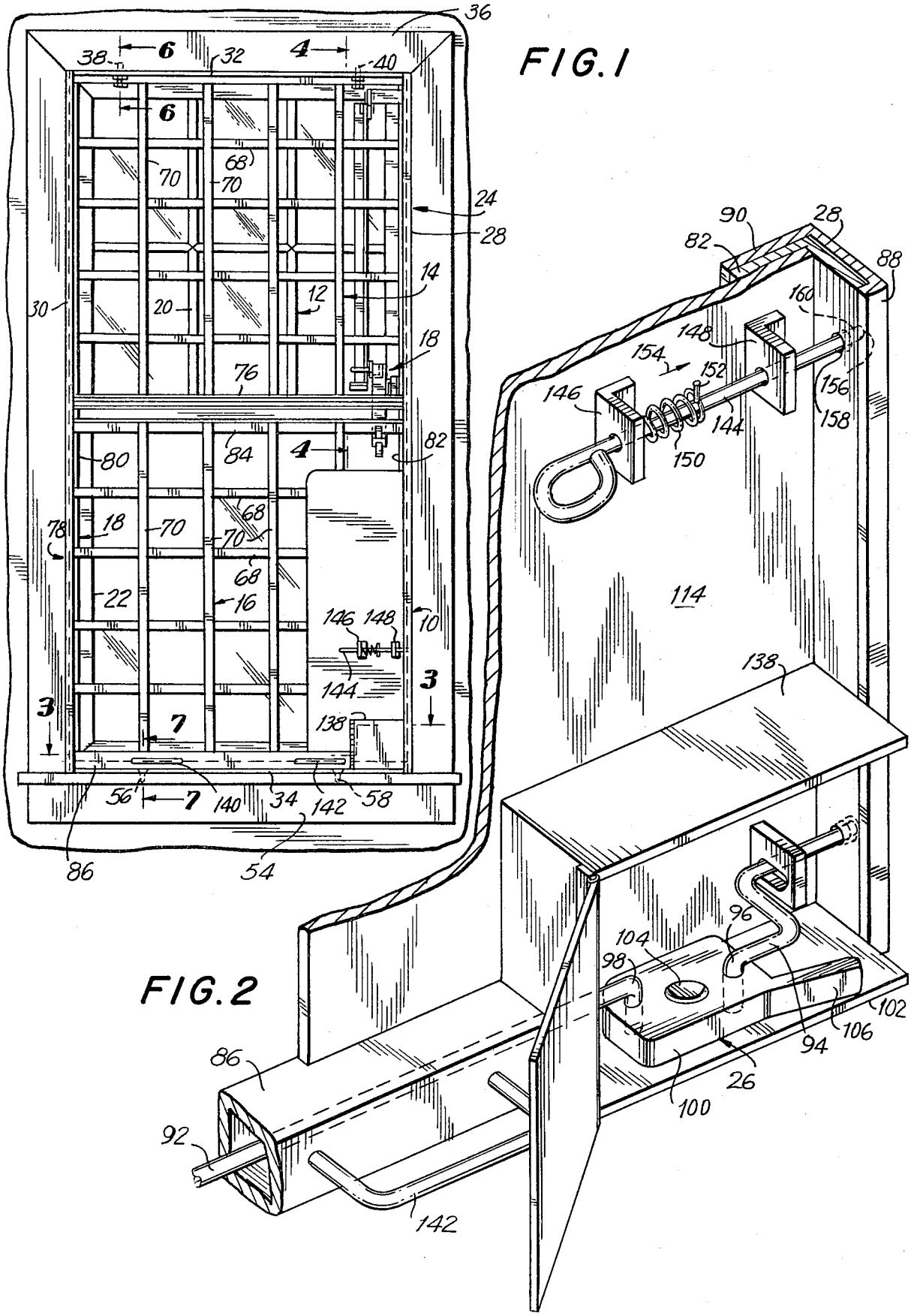
FIG. 1 is a front elevation view of a window gate apparatus, constructed in accordance with the present invention, with the apparatus shown mounted on a double-hung window.
FIG. 2 is a fragmentary perspective view of the operating controls located on the lower portion of the window gate apparatus of FIG. 1.
Figure 9:
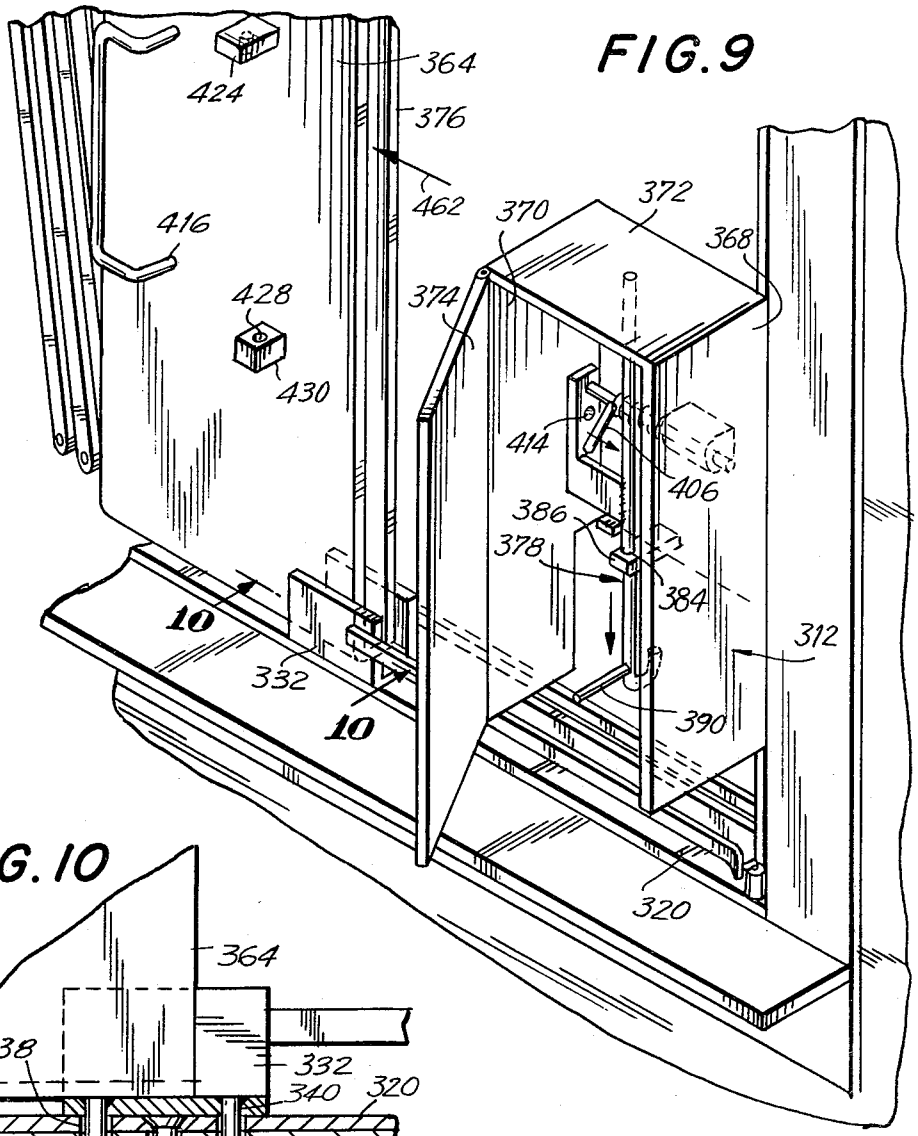
Figure 10:
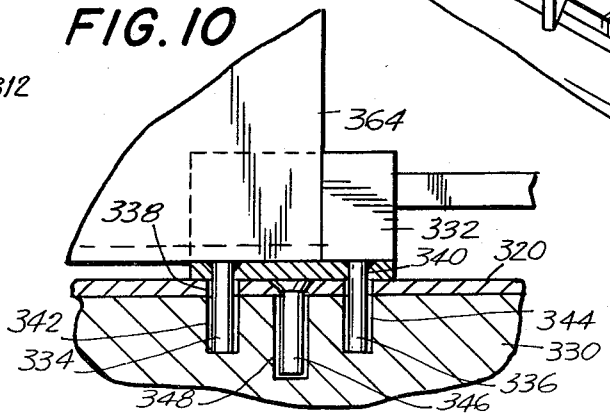
Figure 8:
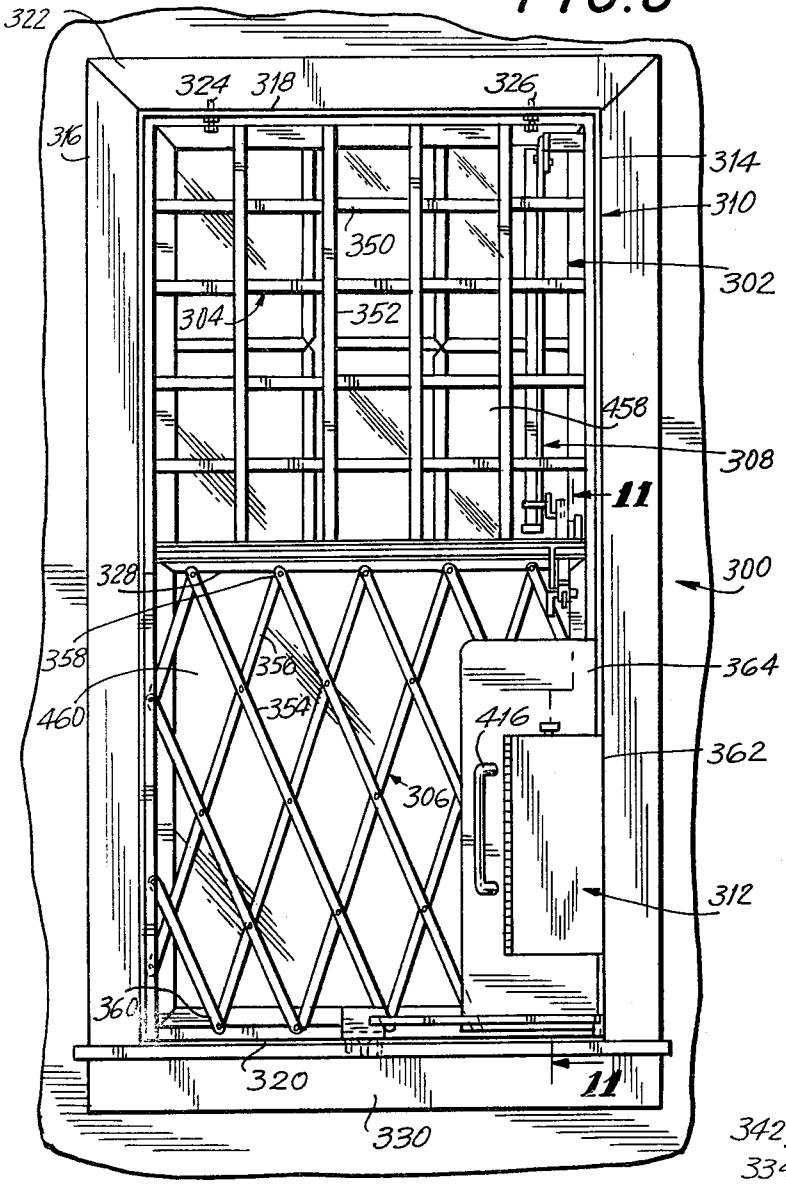

FIC. 7 is a fragmentary cross sectional view taken along the line 7—7 of FIG. 1;

FIG. 8 is a front elevational view of an alternative embodiment of the window gate apparatus of FIG. 1;

FIG. 9 is a fragmentary perspective view of the operating controls located on the lower portion of the window gate of FIG. 8;

FIG. 9 is a fragmentary perspective view of the operating controls located on the lower portion of the window gate of FIG. 8; , FIG. 10 is a fragmentary cross sectional view taken along the line 10—10 of FIG. 9:

FIG. 11 is a cross sectional view taken along the line 11—11 of FIG. 8;

FIG. 12 is a fragmentary cross sectional view taken along the line 12—12 of FIG. 11, and FIG. 13 is a fragmentary perspective view of the upper latch mechanism of the window gate of FIG. 8.

DETAILED DESCRIPTION OF THE PREFERRED EMBODIMENT

With reference to the drawings there is shown in FIG. 1 a grill-type window gate apparatus 10 constructed in accordance with a first embodiment of the present invention with the apparatus shown mounted on a conventional double-hung window 12. The apparatus 10 includes an upper grillwork panel 14, a lower grillwork panel 16, a latch assembly 18, which locks the upper and lower windows 20, 22, a stationary frame assembly 24 and a bolt assembly 26.

Figure 6:
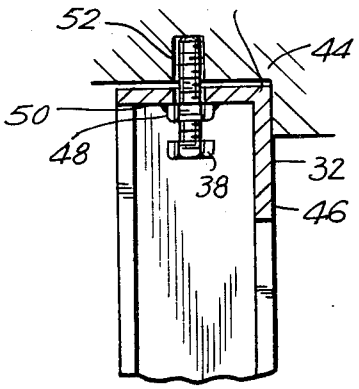
FIG. 6 is a fragmentary cross sectional view taken along the line 6—6 of FIG. 1.

The stationary frame assembly 24 comprises a pair of opposed horizontal members 32, 34. The upper horizontal member 32 is connected to the window jamb 36 by means of a pair of identical spaced apart bolt members 38, 40, one of which is shown drawn to an enlarged scale in FIG. 6. As is best shown in FIG. 6, the upper horizontal member 32 comprises a horizontal leg 42 disposed adjacent to the window jamb portion 44 and a vertical leg 46. The horizontal leg 42 includes a nut 48 welded on the surface 50. The bolt member 38 is threaded into the nut 48 and projects into a hole 52 in the window jamb portion 44.

Figure 7:
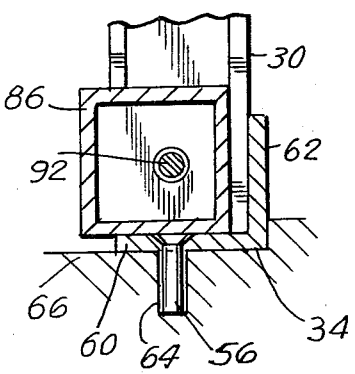

The lower horizontal member 34 is connected to the window jamb 54 by means of a pair of spaced apart pins 56, 58, one of which is shown drawn to an enlarged scale in FIG. 7. As is best shown in FIG. 7, the lower horizontal member 34 comprises a horizontal leg 60 and a vertical leg 62. The pin 56 is mounted on the horizontal leg 60 and projects into a hole 64 in the window jamb portion 66.

The upper and lower grillwork panels 14, 16 each comprise a plurality of horizontal and vertical bars which are generally designated by the reference numerals 68, 70, respectively. The horizontal and vertical bars 68, 70 of the upper grillwork panel 14 are secured to the stationary frame assembly 24 and to each other, at intersecting points to form a grillwork using any one of a number of known manufacturing techniques such as welding or riveting thereby forming a secure assembly capable of preventing unwanted entry through the window 12, even should the glass window panes 72, 74, shown in FIG. 4, be broken.

The stationary frame assembly 24 includes a horizontal member 76 which extends between the vertical members 28, 30. The horizontal member 76 defines the lower edge of the upper grillwork panel 14.

The horizontal and vertical bars 68, 70 of the lower grillwork panel 16 are welded to a frame assembly 78 which comprises vertical members 80, 82 and horizontal members 84, 86.

The vertical members 28, 30 of the stationary frame assembly 24 each includes a relatively shorter and a relatively longer leg portion 88, 90 as is best shown in FIG. 2. The leg portions 88, 90 serve to retain and guide the lower grillwork panel 16 in a manner which will be described presently. The upper grillwork panel 14 is fixed to the stationary frame 24 as has been described. The lower grillwork panel 16 may be raised with respect to the stationary frame 24, guided by the leg portions 88, 90, when the bolt assembly 26 is unlocked.

Figure 3:
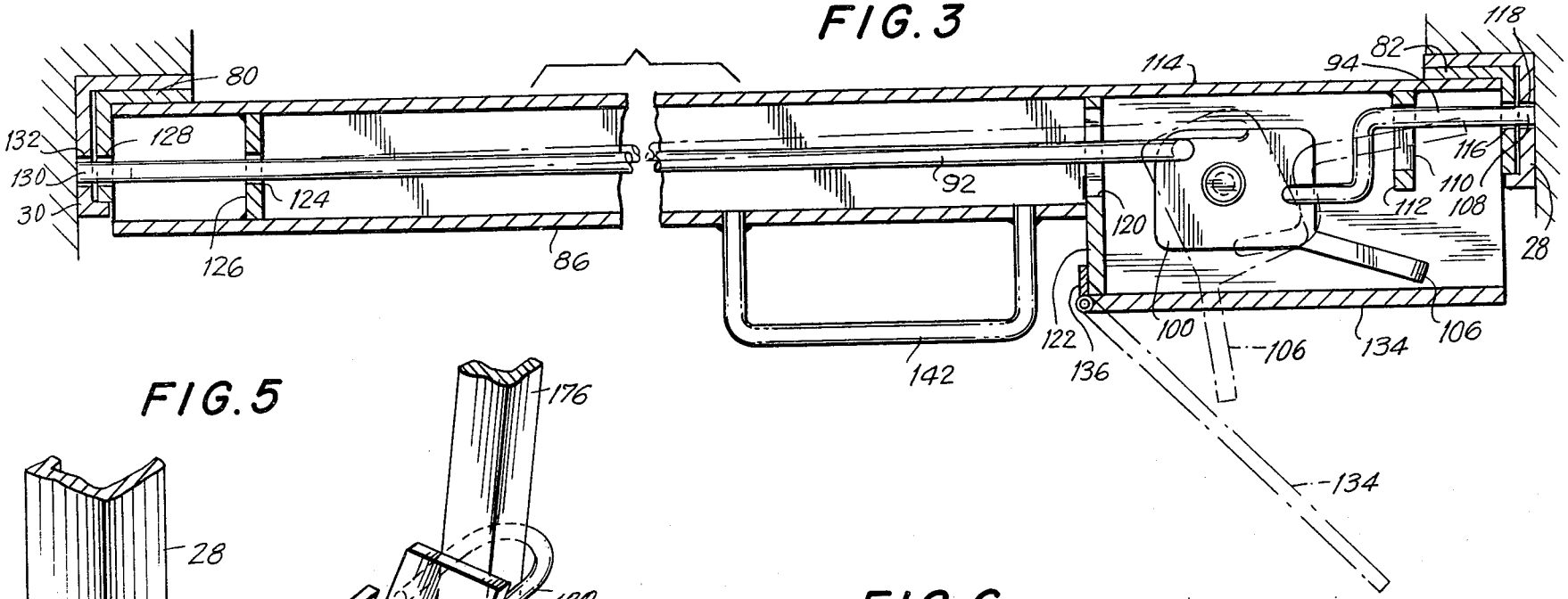
FIG. 3 is a cross sectional view taken along the line 3—3 of FIG. 1.

The bolt assembly 26 is mounted on the lower portion of the lower grillwork panel 16 as is best shown in FIGS. 1, 2 and 3. The bolt assembly 26 includes a pair of bolt members 92, 94 which have end portions 96, 98, respectively, pivotally connected to an operating member 100. The operating member 100 is pivotally mounted on the base plate 102 by means of the pivot 104 and includes an integrally formed handle portion 106. As is shown in solid lines in FIG. 3, the end 108 of the bolt member 94 projects through a slot 110 formed in a guide member 112 mounted on the back plate 114, through a clearance hole 116 in the vertical member 82 of the frame assembly 78 of the lower grillwork panel 16, and projects into a hole 118 formed in the vertical member 28 of the stationary frame assembly 24. The bolt member 92 projects through a clearance hole 120 in the side panel 122, which is mounted on the back plate 114, through a clearance hole 124 formed in the guide member 126, also mounted on the back plate 114, through a clearance hole 128 in the vertical member 80 of the frame assembly 78 of the grillwork panel 16, with the end 130 of the bolt member projecting into a hole 132 formed in the vertical member 30 of the stationary frame assembly 24. The bolts 92, 94 thus serve to lock the lower grillwork panel 16 with respect to the stationary frame assembly 24. A door panel 134 is connected to the side panel 122 by means of a hinge 136 and a top panel 138 is mounted on the back plate 114 thereby enclosing the operating member 100.

The lower horizontal member 86 is tubular, as best shown in FIGS. 2 and 3, and encloses the bolt 92 and prevents access thereto. The back plate 114, top panel 138, side panel 122 and door panel 134 prevent access to the operating member 100 from the outside of the window 12, even should the window panes 72, 74 be broken.

To open the lower grillwork panel 16, the door panel 134 is opened to the position shown in broken lines in FIG. 3 and the handle or lever 106 is used to rotate the operating member 100 to the position shown in broken lines (FIG.3). This action causes the ends 108, 130 of the bolts to be withdrawn from the holes 118, 132 in the stationary frame 24, thereby unlocking the lower grillwork panel 16 which may thereafter be raised by means of the handles 140, 142 mounted on the lower horizontal member 86.

The lower grillwork panel 16 also includes a spring loaded pin member 144 which is slidably mounted in guide members 146, 148 which project from the back plate 114 as is shown in FIGS. 1 and 2. A helical compression spring 150 is mounted on the pin member 144 by means of a pin 152. The helical compression spring 150 causes the pin member 144 to be biased in the direction shown by the arrow 154. The end 156 of the pin member 144 passes through a clearance hole 158 in the vertical member 82 of the grillwork panel 16 and projects into a hole 160 in the vertical member 28 of the stationary frame assembly 24. A plurality of holes may be provided in the vertical member 28 of the stationary frame assembly 24 thereby enabling the lower grillwork panel 16 to be raised to various positions and locked in place by the pin member 144. One of such plurality of holes is indicated by the hole 162 in FIG. 4.

Figure 5:
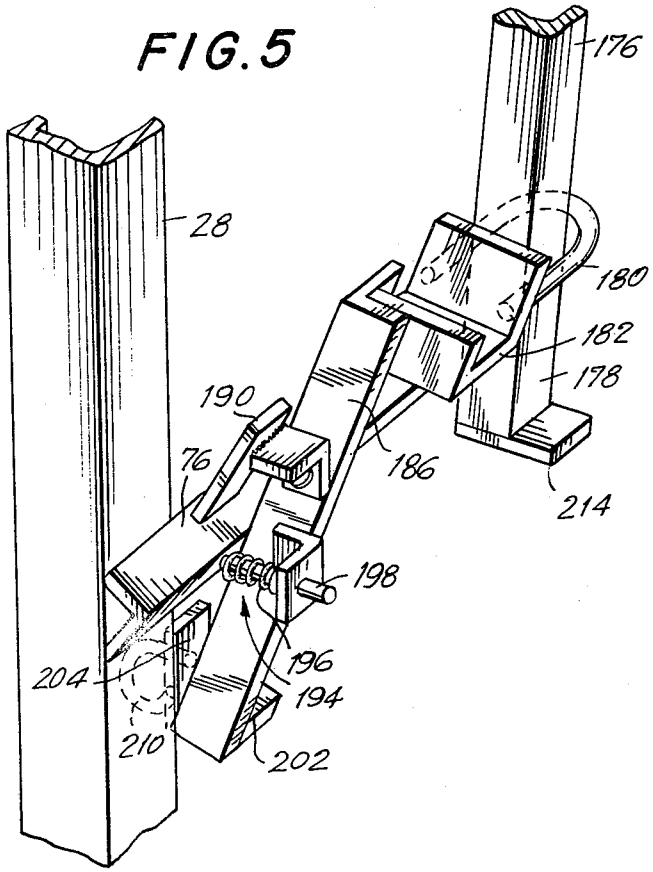
FIG. 5 is a fragmentary perspective view of the upper latch mechanism of the window gate of FIG. 1.
Figure 4:
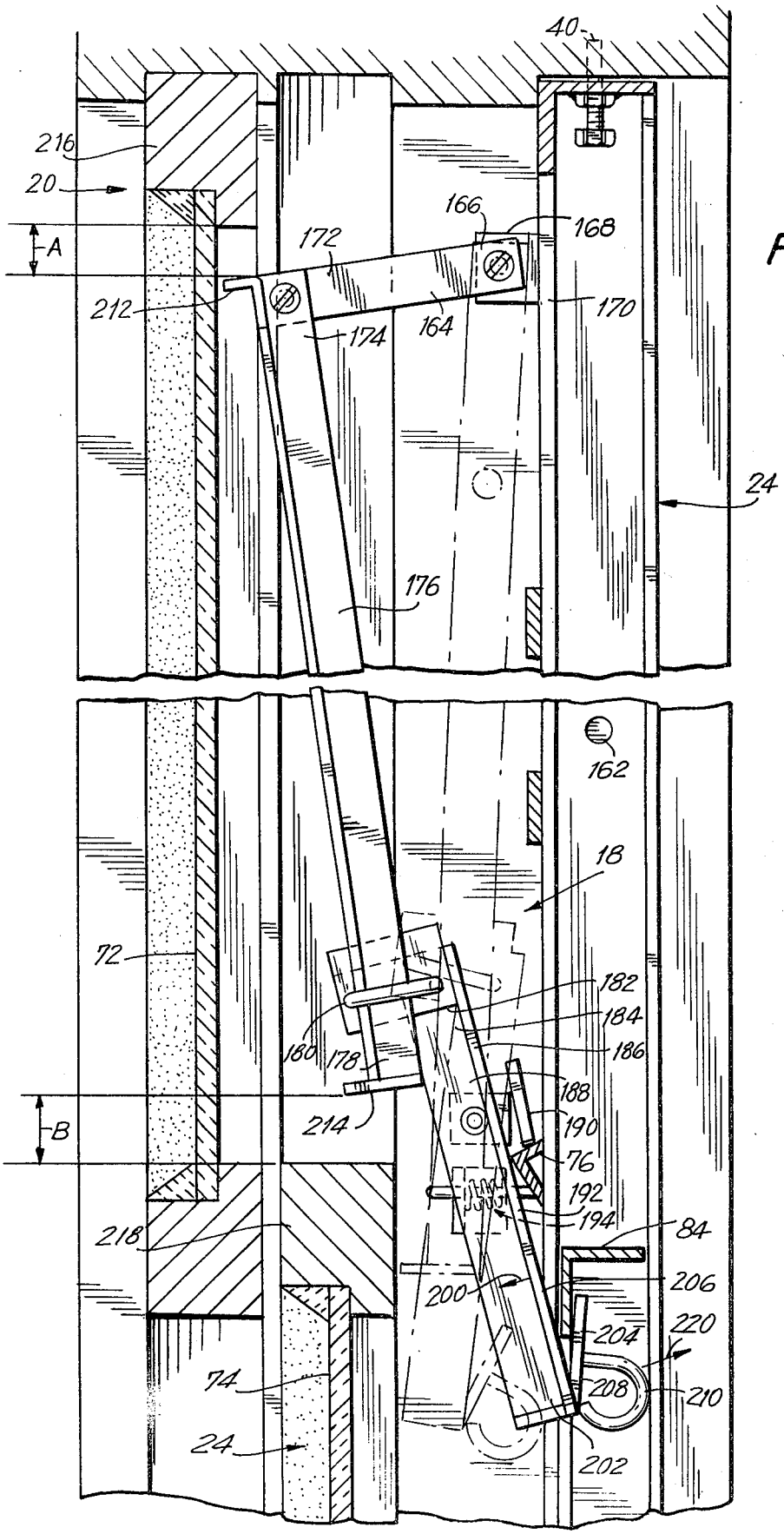
FIG. 4 is a cross sectional view taken along the line 4—4 of FIG. 1.

The upper and lower windows 20, 22 are locked by means of the latch assembly 18 which is best shown in FIGS. 4 and 5. The latch assembly 18 includes a first member 164 which has a first end 166 pivotally connected to a bracket 168 which is mounted on an upper portion 170 of the stationary frame assembly 24. The first member 164 has a second end 172 which is pivotally connected to the first end 174 of a second member 176; the second end 178 of which passes through a ring member 180 mounted on a bracket 182 which in turn is mounted on the first end 184 of a third member 186. An intermediate portion 188 of the third member 186 is pivotally mounted on a bracket 190 which is mounted on the horizontal member 76 of the frame assembly 24. An intermediate portion 192 of the third member 186 includes a spring assembly 194 which comprises a helical compression spring 196 and a pin 198. The spring assembly 194 tends to turn the third member 186 in the direction of the arrow 200 in FIG. 4. The lower end 202 of the third member 186 includes a plate 204 which forms an acute angle with the surface 206 of the third member 186. The surface 208 of the plate 204 includes a handle 210 which is used during the operation of the latch assembly 18.

The first end 174 of the second member 176 has a lip portion 212 and the second end 178 of the second member 176 has a lip portion 214. When the latch assembly 18 is in the locked position, shown in solid lines in FIG. 4, the upper window 20 may be lowered a slight distance, indicated by dimension A until the frame member 216 comes into contact with the lip portion 212 and the lower window 22 may be raised a slight distance indicated by dimension B until the frame member 218 comes into contact with the lip portion 214.

In the locked position, as is shown in FIG. 4, the plate 204 engages the upper horizontal member 84 of the lower grillwork panel 16. The plate 204 holds the third 3 member 186 of the latch assembly 18 in the position shown in solid lines and the third member 186 in turn holds the first and second members 164, 176 in the position shown in solid lines. If the upper window 20 is lowered until the lip 212 comes into contact with the frame portion 216, and continued downward pressure on the upper window 20 is applied, the upper window 20 can be lowered an additional slight amount until the lip 214 comes into contact with the frame member 218, whereupon the upper window 20 cannot be lowered further. Similarly, if the lower window 22 is raised until the frame portion 218 comes into contact with the lip 214 and continued upward pressure is applied on the lower window 22, the lower window 22 can be raised a slight amount until the lip 212 comes into contact with the frame portion 216, whereupon the lower window 22 cannot be raised further.

To lock the latch assembly 18, the lower grillwork panel 16 is first raised while the handle 210 on the latch assembly 18 is pulled in the direction shown by the arrow 20 in FIG. 4. The handle 210 and the plate 204 are held in the position shown in solid lines in FIG. 4 while the lower grillwork panel 16 is lowered, thereby causing the upper horizontal member 84 of the lower grillwork panel 16 to engage the plate 204 and become wedged between the plate 204 and the surface 206 of the third member 186. The lower grillwork panel 16 may then be locked to the stationary frame assembly 24 using the bolt assembly 26 in the manner which has been previously described.

When the lower grillwork panel 16 is unlocked and raised, the horizontal member 84 is moved upwardly away from the plate 204 and the spring 196 causes the third member 186 to pivot in the direction shown by the arrow 200. This causes the first and second members 164, 176 to fall, due to their own weight, to a position in which they are substantially in alignment with the third member 186. This position is shown in broken lines in FIG. 4. In this position, both the upper and the lower windows 20, 22 may be opened without restriction.

FIG. 8 shows an alternative embodiment of the grill-type window gate apparatus of FIG. 1, generally denoted by the reference numeral 300, being mounted on a conventional double-hung window 302. The apparatus 300 includes an upper grillwork panel 304 similar to the upper grillwork panel 14 of FIG. 1, a lower scissors-type grillwork panel 306, a latch assembly 308 which is similar to the latch assembly 18 (FIG. 1), a stationary frame assembly 310 and a bolt assembly 312.

The stationary frame assembly 310 comprises a pair of opposed vertical members 314, 316 and a pair of opposed horizontal members 318, 320. The upper horizontal member 318 is connected to the window jamb 322 by means of a pair of spaced apart bolt members 324, 326 simiar to the bolt members 38, 40 which have been previously described. The stationary frame assembly 310 also includes a central horizontal member 328 which, together with the lower horizontal member 320, guides the lower scissors-type gate 306 in a manner which will be presently described. The lower horizontal member 320 is connected to the window jamb 330 by means of a U-shaped bracket 332 which is best shown in FIGS. 9 and 10. The bracket 332 is connected to the lower horizontal member 320 and includes a pair of pins 334, 336 which project through clearance holes 338, 340, respectively, in the lower horizontal member 320 and project into holes 342, 344 in the window jamb 330, as is shown in FIG. 10. The lower horizontal member 320 includes a pin 346 which projects into a hole 348 in the window jamb 330.

The upper grillwork panel 304 comprises a plurality of horizontal and vertical bars which are generally designated by the reference numerals 350, 352, respectively. The upper grillwork panel 304 is similar to the upper grillwork panel 14 shown in FIG. 1 and will not be described in detail.

The lower scissors-type grillwork panel 306 comprises a first plurality of parallel bars, denoted generally by the reference numeral 354, and a second plurality of parallel bars, denoted generally by the reference numeral 356. The first and second pluralities of bars 354, 356 intersect and each of the intersections are pivotally connected to form a scissors-type parallel action assembly. This type of grillwork is well known and need not be described in detail. As is shown in FIGS. 8, 9 and 11, the upper and lower portions 358, 360 of the grillwork 306 are guided by the horizontal members 328, 320, respectively. The bolt assembly 312 is mounted on the lower portion 362 of the stationary frame assembly 310 and cooperates with a plate member 364 mounted on the grillwork 306 to lock the grillwork 306 to the stationary frame assembly 310.

The bolt assembly 312 includes a back panel 366, a pair of spaced apart side panels 368, 370, a top panel 372 and a hinged front door panel 374. As best seen in FIGS. 9, 11 and 12, the bolt assembly 312 is disposed so as to permit the plate member 364 which is mounted on the grillwork panel 306 to slide behind the bolt assembly 312 when the grillwork panel 306 is in the closed position. A second plate member 376 is mounted directly opposite the plate member 364 on the grillwork panel 306. The bolt assembly 312 includes a bolt member 378 which has a vertically disposed first portion 380 and a curved lower portion 382 together forming the general configuration of a capital letter J. The first portion 380 passes through a clearance hole 384 formed in a guide bracket 386 mounted on the back panel 366. The bolt member 378 is free to move in a vertical direction, as indicated by the arrow 388 in FIG. 12. An operating handle 390 is mounted on the lower portion 392 of the bolt member 378, as shown in FIG. 11. A bracket 394 which includes a horizontal portion 396 and a vertical portion 398 is mounted on an intermediate portion 400 of the bolt member 378. A spring loaded pin member 402 is mounted on the back panel 366 by means of a guide bracket 404. The pin member 402 includes a handle member 406 and is urged to move in the direction shown by the arrow 408 in FIG. 12 by the action of a helical compression spring 410 which is mounted on the pin member 402 and which bears on the handle member 406 and the guide bracket 404. The end 412 of the pin member 402 is thus urged toward the vertical portion 398 of the bracket which includes a hole 414 which admits the end 412 of the pin member 402 thereby locking the bolt member 378 in an upper position. To lock the grillwork panel 306 to the stationary frame assembly 310, the plate member 364 is moved behind the back panel 366 using the handle 416 mounted on the plate member 364 and the bolt member 378 is raised to an upper position using the handle 390. When in the upper position, the upper end 418 of the bolt member 378 passes through a clearance hole 420 in the top panel 372 and projects into a hole 422 in an upper bracket 424 mounted on the plate member 364. The lower end 426 of the bolt member 378 projects into a hole 428 in a lower bracket 430 mounted on the plate member 364.

To unlock the grillwork panel 306, handle member 406 is moved in the direction shown by the arrow 432 in FIG. 12 and the pin member 402 is withdrawn from the vertical portion 398 of the bracket 394 outwardly of hole 414. The bolt member 378 now falls due to its own weight to the position indicated by broken lines in FIG. 11 and the upper and lower ends 418, 426 of the bolt member 378 are free of the upper and lower brackets 424, 430. The grillwork panel can now be opened by moving the handle 416 in the direction shown by the arrow 462 in FIG. 9. When the bolt member 378 falls to its lower position, the bracket 394 comes into contact with the stop member 468 which is mounted on the back panel 366.

The latch assembly 308 of the alternative embodiment of the apparatus 300 is the same as the latch assembly 18 of the apparatus 10 of the first embodiment. The lower grillwork panel 306 includes an angle bracket 434 which engages the latch assembly 308 in a manner similar to the horizontal member 84 of FIG. 4. As best shown in FIG. 13, the angle bracket 434 is fastened to the bar 436 of the grillwork panel 306 by means of rivets 438, 440. The angle bracket 434 includes a vertical portion 442 and a horizontal portion 444. The horizontal portion 444 engages the member 446 of the latch assembly 308, which corresponds to the plate member designated by the reference numeral 204 in FIG. 4. The angle bracket 434 includes a guide bar 448 which has a lower end 450 welded to the horizontal portion 444 of the angle bracket 434, and an upper end 452 which bears against and is guided by the legs 464, 466 of the horizontal member 328 of the stationary frame assembly 310. The upper end 452 of the guide bar 448 continues to bear against the horizontal member 328 when the grillwork panel 306 is moved to the open position and maintains the position of the angle bracket 434 relative to the latch assembly 308 when the grillwork panel 306 is in the closed position.

The latch assembly 308 is engaged by first pulling the handle 454 in the direction shown by the arrow 456 in FIG. 11 and moving the grillwork panel 306 to the closed position shown in FIG. 8. The latch member 446 engages the angle bracket 434 as is shown in FIGS. 11 and 13 thereby preventing more than a relatively small opening of either the upper or the lower window, as previously described. The grillwork panel 306 may then be locked to the stationary frame assembly 310 using the bolt member 378 in the manner which has been previously described.

The plate members 364, 376, the back panel 366, the side panels 368, 370, the top panel 372 and the door panel 374 cooperate to enclose the bolt assembly 312 and prevent unwanted access thereto from outside the window 302, even should the glass window panes 458, 460 be broken, thereby providing an additional measure of security.

While I have shown and described the preferred embodiments of the present invention, it will be appreciated that the teachings herein will lend itself to many modifications, changes, combinations and improvements by those skilled in the art without deviating from the present invention or the teachings thereof.

What is claimed is:

1. A grill-type window gate apparatus for securing an opening in a building comprising frame means capable of being mounted with respect to the walls of a building defining said opening, mounting means for connecting said frame means with respect to said walls, a grillwork panel slidably mounted on said frame means, said grillwork panel being capable of movement between an open and a closed position, panel locking means mounted on said grillwork panel capable of locking said grillwork panel to said frame means when said grillwork panel is in said closed position, window locking means mounted on said frame means for locking a window mounted in said opening, said window locking means having an open position and a locked position, and said window locking means being operably connected with said grillwork panel to maintain said locked position when said grillwork panel is in said closed position.

2. A grill-type window gate apparatus in accordance with claim 1, wherein said grillwork panel comprises a rectangular grillwork array.

3. A grill-type window gate apparatus in accordance with claim 1, wherein said panel locking means comprises at least one slidably mounted bolt mounted on said grillwork panel capable of engaging said frame means to thereby lock said grillwork panel to said frame means.

4. A grill-type window gate apparatus in accordance with claim 1, wherein said window is of the double-hung-type, and said window locking means comprises bar means interposed between an upper frame and a lower frame of said double-hung-type window for preventing lowering of said upper frame and raising of said lower frame when said window locking means is in said locked position.

5. A grill-type window gate apparatus, in accordance with claim 4 wherein said window locking means further comprises first link means having a first end pivotally connected to an upper end of said bar means and a second end pivotally connected to said frame means, second link means having a central portion pivotally connected to said frame means, said second link means having a first end slidably connected to a lower end of said bar means and a second end having engagement means capable of engaging said grillwork panel when said grillwork panel is in said closed position, and spring means adapted to rotate said second link means and said bar means toward said open position.

6. A grill-type window gate in accordance with claim 1, wherein said grillwork panel comprises a scissor-type grill.

7. A grill-type window gate apparatus in accordance with claim 6, wherein said grillwork panel is capable of movement between an extended closed position and a retracted open position.

8. A grill-type window gate apparatus in accordance with claim 6, including guide means for guiding said grillwork panel relative to said frame means.

9. A grill-type window gate apparatus in accordance with claim 1, wherein said grillwork panel is capable of movement between an upper open position and a lower closed position.

10. A grill-type window gate apparatus in accordance with claim 9, comprising locking means capable of locking said grillwork panel in said upper position.

11. A grill-type window gate apparatus in accordance with claim 1, wherein said panel locking means comprises a pair of bolt members each slidably mounted on said grillwork panel, each of said bolt members having a first end and a second end, and each of said bolt members being capable of movement between an extended position and a retracted position, said first ends of each of said bolt members being capable of engaging said frame means for locking said grillwork panel to said frame means when said bolt members are in said extended positions, and inc1uding handle means pivotally mounted on said grillwork panel, said second ends of each of said bolt members being pivotally mounted on said handle means, and rotational movement of said handle means controlling said bolt members to cause sliding movement thereof into and out of said extended position for locking and unlocking said grillwork panel.

12. A grill-type window gate apparatus in accordance with claim 11, wherein said bolt members are generally horizontally disposed.

13. A grill-type window gate apparatus in accordance with claim 11, comprising enclosure means mounted on said grillwork panel, and said enclosure means including a door panel for enclosing said handle means.

14. A grill-type window gate apparatus, in accordance with claim 1, wherein said panel locking means includes a slidably mounted bolt member.

15. A grill-type window gate apparatus in accordance with claim 14, wherein said bolt member is generally vertically disposed.

16. A grill-type window gate apparatus in accordance with claim 14, comprising bracket means mounted on said grillwork panel, said bracket means being capable of engagement by said bolt member when the same is in an upper position, a pin member slidably mounted on said grillwork panel, a bolt bracket mounted on said bolt member, and said bolt bracket being capable of engagement by said pin member for locking said bolt member in said upper position.

17. A grill-type window gate apparatus in accordance with claim 16, wherein said bracket means mounted on said grillwork panel comprises an upper bracket and a lower bracket, said upper bracket being capable of engaging an upper end of said bolt member, and said lower bracket being capable of engaging a lower end of said bolt member.

18. A grill-type window gate apparatus in accordance with claim 16, comprising enclosure means mounted on said frame means for enclosing said bolt member and said pin member, and said enclosure means including a door panel.

19. A grill-type window gate apparatus in accordance with claim 18, wherein said enclosure means includes an aperture, and said bolt member in its upper position is adapted to project through said aperture.

* * * * *